US011040538B2

(12) United States Patent
Suzuki et al.

(10) Patent No.: US 11,040,538 B2
(45) Date of Patent: Jun. 22, 2021

(54) INKJET PRINTER AND MAINTENANCE METHOD

(71) Applicant: SCREEN HOLDINGS CO., LTD., Kyoto (JP)

(72) Inventors: Yuto Suzuki, Kyoto (JP); Katsuaki Takeuchi, Kyoto (JP); Mitsuru Tanemoto, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 16/554,179

(22) Filed: Aug. 28, 2019

(65) Prior Publication Data

US 2020/0094574 A1 Mar. 26, 2020

(30) Foreign Application Priority Data

Sep. 21, 2018 (JP) ..... JP2018-177970

(51) Int. Cl.
*B41J 2/165* (2006.01)
*B41J 2/175* (2006.01)
*B41J 2/20* (2006.01)

(52) U.S. Cl.
CPC ..... *B41J 2/1652* (2013.01); *B41J 2/17596* (2013.01); *B41J 2/20* (2013.01)

(58) Field of Classification Search
CPC ..... B41J 2/1652; B41J 2/17596
See application file for complete search history.

(56) References Cited

U.S. PATENT DOCUMENTS

2009/0189960 A1* 7/2009 Matsuda ..... B41J 2/18 347/77
2014/0085376 A1* 3/2014 Kato ..... C09D 11/30 347/33

FOREIGN PATENT DOCUMENTS

JP 2016-187884 A 11/2016

* cited by examiner

*Primary Examiner* — Justin Seo
(74) *Attorney, Agent, or Firm* — McDermott Will & Emery LLP

(57) ABSTRACT

An inkjet printer includes a maintenance solution supply mechanism. In response to switching of a three-way valve provided in an ink pipe, a maintenance solution is supplied from a maintenance tank to each head through a maintenance pipe. The maintenance tank is a common tank. This suppresses size increase of the printer compared to provision of an individual maintenance tank for each head. The maintenance pipe is connected to the ink pipe at a position downstream of an intermediary tank. This eliminates the need of replacement of ink in the intermediary tank by the maintenance solution during supply of the maintenance solution. This allows reduction in the consumptions of the ink and the maintenance solution.

9 Claims, 5 Drawing Sheets

INKJET PRINTER AND MAINTENANCE METHOD

RELATED APPLICATIONS

This application claims the benefit of Japanese Application No. 2018-177970, filed on Sep. 21, 2018, the disclosure of which is incorporated by reference herein.

BACKGROUND OF THE INVENTION

Field of the Invention

The present invention relates to an inkjet printer and a maintenance method of maintaining a head in an inkjet printer.

Description of the Background Art

An inject printer for commercial printing prints an image on a surface of elongated strip-shaped printing paper by ejecting ink from a plurality of heads while transporting the printing paper along a predetermined transport path. The inject printer of such a type is provided with ink tanks as sources of inks of corresponding colors, C, M, Y, and K. The ink tank and the head are connected through a pipe. Ink stored in the ink tank is supplied through the pipe to the head by the pressure of a pump provided in the pipe.

The conventional inkjet printer is disclosed in Japanese Patent Application Laid-Open No. 2016-187884, for example.

SUMMARY OF THE INVENTION

The head of the inkjet printer ejects ink droplets from a large number of tiny nozzles. In some cases, these nozzles encounter clogging to be caused by drying of ink or adherence of foreign substances. To eliminate or prevent such nozzle clogging, the inkjet printer is subjected to the process of supplying the head with a maintenance solution such as a cleaning solution regularly.

In the conventional inkjet printer, the head has been supplied with the maintenance solution by replacing an ink tank as a source of ink by a tank of the maintenance solution. However, this method necessitates replacement of the ink in an ink supply path as a whole by the maintenance solution. In particular, if an intermediary tank is provided on the ink supply path, ink in the intermediary tank is also required to be replaced by the maintenance solution. This results in mass consumptions of the ink and the maintenance solution during supply of the maintenance solution.

A mechanism of supplying the maintenance solution to each head may be provided separately from the ink supply path. However, individually providing the mechanism of supplying the maintenance solution to each head unfortunately causes size increase of the printer as a whole.

The present invention is intended to provide an inkjet printer and a maintenance method capable of supplying a maintenance solution instead of ink to a plurality of heads while suppressing size increase of the printer, and capable of reducing the consumptions of the ink and the maintenance solution.

One aspect of this application is intended for an inkjet printer.

The inkjet printer comprises: a first head that ejects first ink toward a printing medium; a second head that ejects second ink of a different color from the first ink toward the printing medium; a first ink supply mechanism that supplies the first ink to the first head; a second ink supply mechanism that supplies the second ink to the second head; and a maintenance solution supply mechanism that supplies a maintenance solution to the first head and the second head. The first ink supply mechanism includes: a first ink pipe through which the first ink is supplied from a first tank to the first head; and a first three-way valve provided on a path along the first ink pipe. The second ink supply mechanism includes: a second ink pipe through which the second ink is supplied from a second tank to the second head; and a second three-way valve provided on a path along the second ink pipe. The maintenance solution supply mechanism includes a maintenance pipe through which the maintenance solution is supplied from a maintenance tank storing the maintenance solution to the first three-way valve and the second three-way valve.

Switching the first three-way valve and the second three-way valve allows supply of the maintenance solution instead of ink to the first head and the second head. The maintenance solution is supplied to the first head and the second head from the common maintenance tank. This makes it possible to suppress size increase of the printer.

The maintenance pipe is connected to the first ink pipe and the second ink pipe at positions downstream of the first tank and the second tank. This eliminates the need of replacement of the inks in the first tank and the second tank by the maintenance solution during supply of the maintenance solution. This allows reduction in the consumptions of the inks and the maintenance solution.

Preferably, the maintenance pipe includes: a common pipe extending from the maintenance tank; a first branch pipe connecting the common pipe and the first three-way valve; and a second branch pipe connecting the common pipe and the second three-way valve.

Even if the ink of a small amount flows backward from the first three-way valve into the first branch pipe or from the second three-way valve into the second branch pipe, this ink is unlikely to reach the common pipe. This makes it possible to reduce the occurrence of mixture of ink colors through the common pipe.

Preferably, each of the first branch pipe and the second branch pipe has a length of 30 mm or more.

The probability of reach of the ink from the first three-way valve or the second three-way valve to the common pipe is reduced further. This makes it possible to reduce the occurrence of mixture of ink colors through the common pipe to a greater extent.

Preferably, the first ink supply mechanism further includes a first pump located downstream of the first three-way valve on the path along the first ink pipe. The second ink supply mechanism further includes a second pump located downstream of the second three-way valve on the path along the second ink pipe. The inkjet printer further comprises a controller that controls the first three-way valve, the second three-way valve, the first pump, and the second pump. For switching of the first three-way valve from a normal state of forming connection to the first tank to a maintenance state of forming connection to the maintenance tank, the controller makes the switching while the first pump is being driven and continues driving of the first pump until the first three-way valve is switched again to the normal state. For switching of the second three-way valve from a normal state of forming connection to the second tank to a maintenance state of forming connection to the maintenance tank, the controller makes the switching while the second pump is being driven and continues driving of the second pump until the second three-way valve is switched again to the normal state.

The occurrence of backflow of the ink is reduced from the first three-way valve or the second three-way valve to the maintenance pipe. This makes it possible to reduce the occurrence of mixture of ink colors through the maintenance pipe.

Preferably, the first ink is black ink, the second ink is ink of a color other than black, and the first three-way valve is connected to a position of the maintenance pipe downstream of the second three-way valve.

The first three-way valve corresponding to the black ink is connected to the position of the maintenance pipe downstream of the second three-way valve corresponding to ink of a different color. This makes it possible to reduce the occurrence of mixture of the black ink to exert large influence on a printing result with the ink pipe corresponding to the different color through the maintenance pipe.

Preferably, each of the first tank and the second tank is an intermediary tank that temporarily stores ink supplied from a source of the ink.

Preferably, the maintenance solution is a cleaning solution used for cleaning the first head and the second head.

Another aspect of the invention is intended for a maintenance method employed in an inkjet printer that supplies first ink from a first tank to a first head through a first ink pipe and supplies second ink of a different color from the first ink from a second tank to a second head through a second ink pipe. The method is for maintaining the first head and second head.

The maintenance method comprises the steps of: a) supplying a maintenance solution from a maintenance tank to the first head by switching a first three-way valve provided in the first ink pipe; and b) supplying the maintenance solution from the maintenance tank to the second head by switching a second three-way valve provided in the second ink pipe.

Preferably, in the step a), while a first pump located downstream of the first three-way valve on a path along the first ink pipe is being driven, the first three-way valve is switched from a normal state of forming connection to the first tank to a maintenance state of forming connection to the maintenance tank, and driving of the first pump is continued until the first three-way valve is switched again to the normal state. In the step b), while a second pump located downstream of the second three-way valve on a path along the second ink pipe is being driven, the second three-way valve is switched from a normal state of forming connection to the second tank to a maintenance state of forming connection to the maintenance tank, and driving of the second pump is continued until the second three-way valve is switched again to the normal state.

The occurrence of backflow of the ink is reduced from the first three-way valve or the second three-way valve toward the maintenance tank. This makes it possible to reduce the occurrence of mixture of ink colors through a pipe for supply of the maintenance solution.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
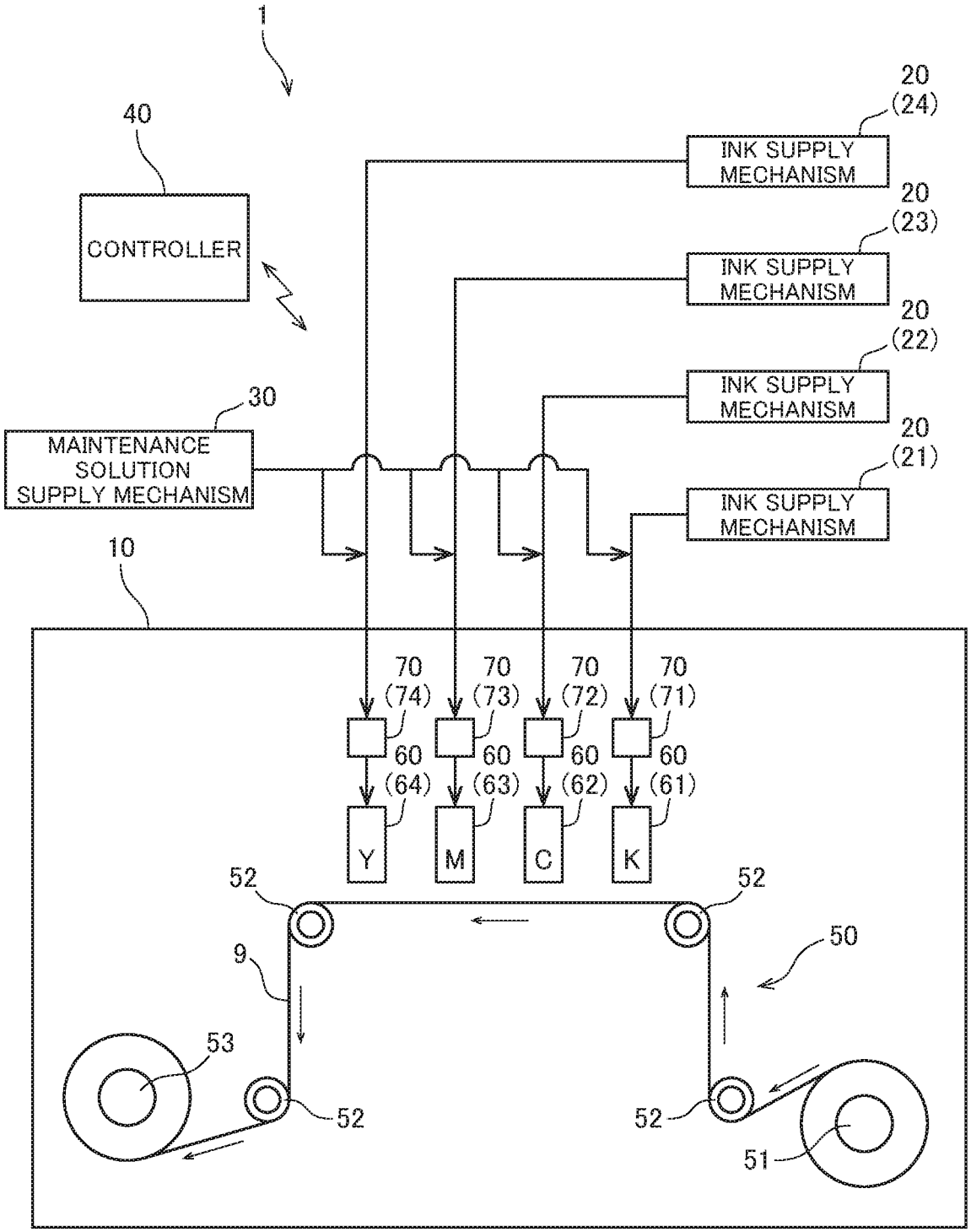
FIG. 1 shows the configuration of an inkjet printer.

A preferred embodiment of the present invention will be described below by referring to the drawings.

<1. Configuration of Inkjet Printer>

FIG. 1 shows the configuration of an inkjet printer 1 according to a preferred embodiment of the present invention. The inkjet printer 1 is an apparatus that prints a color image on a surface of printing paper 9 that is an elongated strip-shaped printing medium by ejecting ink toward the printing paper 9 from a plurality of heads 60 while transporting the printing paper 9. As shown in FIG. 1, the inkjet printer 1 includes a printer body 10, four ink supply mechanisms 20, one maintenance solution supply mechanism 30, and a controller 40.

<1-1. Printer Body>

The printer body 10 includes a transport mechanism 50, four heads 60, and four sub-tanks 70.

The transport mechanism 50 is a mechanism that transports the printing paper 9 in a transport direction along the length of the printing paper 9. The transport mechanism 50 of the preferred embodiment includes an unwinding part 51, a plurality of transport rollers 52, and a winding part 53. The printing paper 9 is unwound from the unwinding part 51, and is transported along a transport path configured using the transport rollers 52. Each of the transport rollers 52 rotates about a horizontal axis while contacting the printing paper 9 to guide the printing paper 9 downstream along the transport path. The transported printing paper 9 is collected on the winding part 53.

The four heads 60 are arranged at regular intervals along the transport path of the printing paper 9. Each of the heads 60 includes a plurality of nozzles aligned parallel to the width direction of the printing paper 9 (a horizontal direction perpendicular to the transport direction). The four heads 60 eject ink droplets of corresponding colors, black (K), cyan (C), magenta (M), and yellow (Y) to become color components of a color image from the nozzles toward a surface of the printing paper 9.

The four heads 60 include a head 60 that ejects color K ink (first ink), a head 60 that ejects color C ink (second ink), a head 60 that ejects color M ink (third ink), and a head 60 that ejects color Y ink (fourth ink), and these heads 60 will be called a "first head 61," a "second head 62," a "third head 63," and a "fourth head 64" respectively. In the preferred embodiment, the first head 61, the second head 62, the third head 63, and the fourth head 64 are aligned in this order along the transport path of the printing paper 9. Meanwhile, the first to fourth heads 61 to 64 may be aligned in different order.

The four sub-tanks 70 are containers for storing inks to be ejected. The four sub-tanks 70 store inks of corresponding ones of the colors K, C, M, and Y. Each of the four heads 60 is connected to the sub-tank 70 storing ink of a color to be ejected through a pipe. Ink supplied from the ink supply mechanism 20 described later is stored once in the sub-tank 70 arranged in the printer body 10. Each of the heads 60 ejects the ink stored in the sub-tank 70 from the nozzles in response to an image to be printed.

The four sub-tanks 70 include a sub-tank 70 connected to the first head 61, a sub-tank 70 connected to the second head 62, a sub-tank 70 connected to the third head 63, and a sub-tank 70 connected to the fourth head 64, and these sub-tanks 70 will be called a "first sub-tank 71," a "second sub-tank 72," a "third sub-tank 73," and a "fourth sub-tank 74" respectively. The first sub-tank 71 stores the color K ink to be used by the first head 61. The second sub-tank 72 stores the color C ink to be used by the second head 62. The third sub-tank 73 stores the color M ink to be used by the third head 63. The fourth sub-tank 74 stores the color Y ink to be used by the fourth head 64.

While the inkjet printer 1 operates, the first head 61 ejects droplets of the color K ink to print a single-color image of the color K on a surface of the printing paper 9. The second head 62 ejects droplets of the color C ink to print a single-color image of the color C on the surface of the printing paper 9. The third head 63 ejects droplets of the color M ink to print a single-color image of the color M on the surface of the printing paper 9. Further, the fourth head 64 ejects droplets of the color Y ink to print a single-color image of the color Y on the surface of the printing paper 9. These four single-color images are superimposed on each other to form a color image on the surface of the printing paper 9.

A drying processor for drying the inks ejected on the surface of the printing paper 9 may further be provided downstream of the four heads 60 along the transport path. The drying processor is to dry the inks by blowing heated gas toward the printing paper 9 and evaporating a solvent in the inks adhering to the printing paper 9, for example. The drying processor may be configured to dry the inks by light irradiation. Alternatively, the drying processor may be configured to heat and dry the inks adhering to the printing paper 9 by winding the printing paper 9 on a heat roller.

<1-2. Ink Supply Mechanism>

Figure 2:
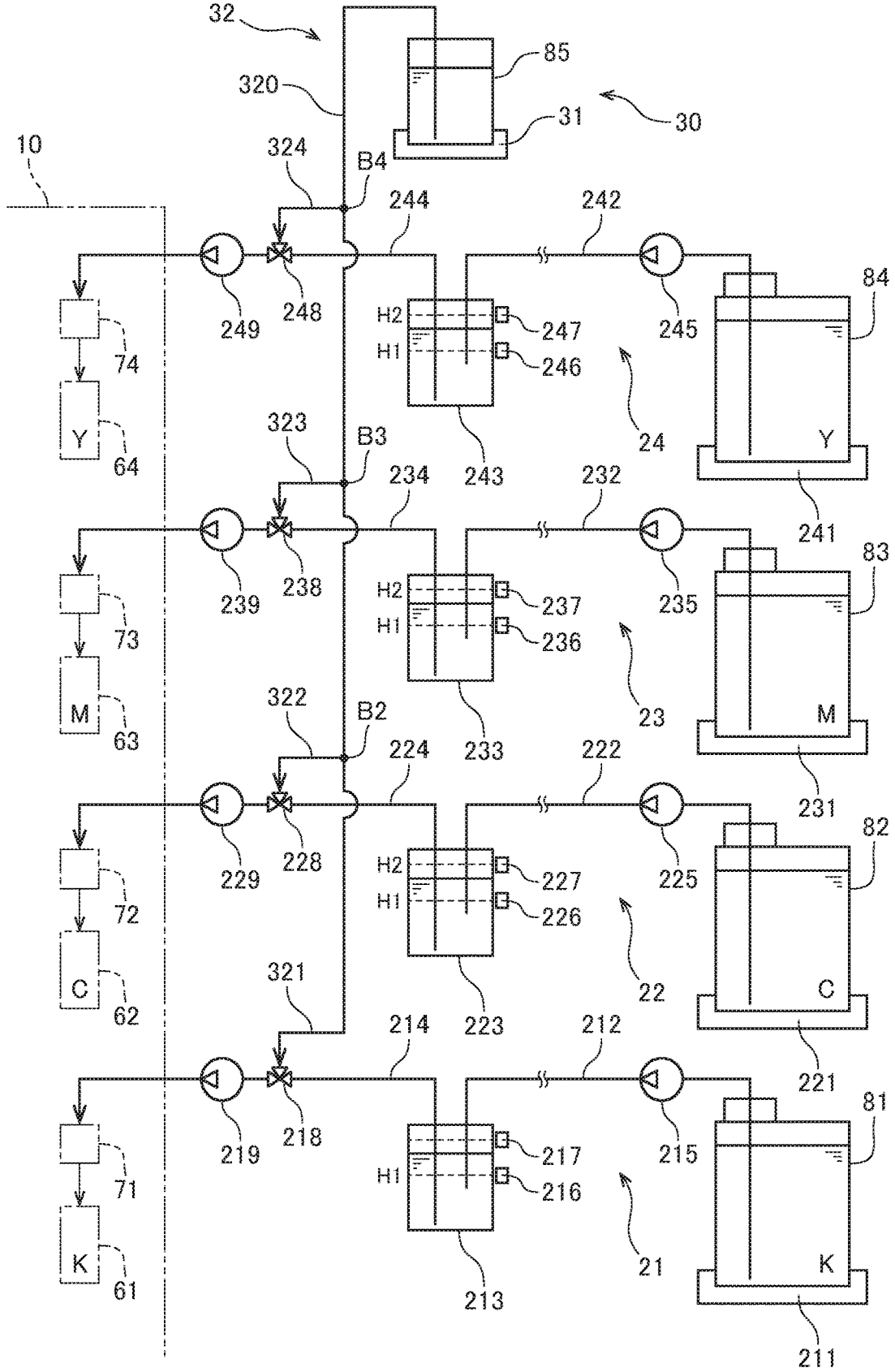
FIG. 2 shows the configurations of four ink supply mechanisms and that of a maintenance solution supply mechanism.

The four ink supply mechanisms 20 are mechanisms that supply inks of corresponding colors from an ink tank installed outside the printer body 10 to the sub-tanks 70 inside the printer body 10. FIG. 2 shows the configurations of the four ink supply mechanisms 20 and that of the maintenance solution supply mechanism 30 described later.

The four ink supply mechanisms 20 include an ink supply mechanism 20 that supplies the color K ink to the first head 61, an ink supply mechanism 20 that supplies the color C ink to the second head 62, an ink supply mechanism 20 that supplies the color M ink to the third head 63, and an ink supply mechanism 20 that supplies the color Y ink to the fourth head 64, and these ink supply mechanisms 20 will be called a "first ink supply mechanism 21," a "second ink supply mechanism 22," a "third ink supply mechanism 23," and a "fourth ink supply mechanism 24" respectively.

As shown in FIG. 2, the first ink supply mechanism 21 includes a first ink tank holder 211, an upstream first ink pipe 212, a first intermediary tank 213, and a downstream first ink pipe 214.

The first ink tank holder 211 is a base for supporting a first ink tank 81 as a source of the color K ink. The first ink tank 81 is placed at the upper surface of the first ink tank holder 211. The first ink tank 81 is a container having a cylindrical lateral surface, for example. The first ink tank 81 stores the color K ink in an unused condition therein. Initially, the ink in the first ink tank 81 is stored to an amount set at 200 liters, for example. The first ink tank 81 may be supported directly on a predetermined support surface of the ink supply mechanism 21 without intervention of the first ink tank holder 211.

The upstream first ink pipe 212 is a pipe for supplying the ink from the first ink tank 81 to the first intermediary tank 213. An upstream end of the upstream first ink pipe 212 is connected to the first ink tank 81. A downstream end of the upstream first ink pipe 212 is connected to the first intermediary tank 213. As shown in FIG. 2, an upstream first pump 215 is interposed in a path along the upstream first ink pipe 212. The upstream first pump 215 is a liquid feeder that forms a downstream flow of the ink in the upstream first ink pipe 212. When the upstream first pump 215 is operated, the color K ink is supplied from the first ink tank 81 to the first intermediary tank 213 through the upstream first ink pipe 212.

The first intermediary tank 213 is a tank storing the color K ink between the upstream first ink pipe 212 and the downstream first ink pipe 214. The capacity of the first intermediary tank 213 is smaller than that of the first ink tank 81. The capacity of the first intermediary tank 213 is 20 liters, for example. The first intermediary tank 213 functions as a buffer that stores the color K ink temporarily to prevent shortage of the ink occurring at a location downstream of the first intermediary tank 213.

As shown in FIG. 2, a first lower limit sensor 216 and a first upper limit sensor 217 are provided near the first intermediary tank 213. The first lower limit sensor 216 is a sensor that determines the presence or absence of the ink at a predetermined lower limit position H1 at the first intermediary tank 213. The first upper limit sensor 217 is a sensor that determines the presence or absence of the ink at a predetermined upper limit position H2 at the first intermediary tank 213 higher than the lower limit position H1. The first lower limit sensor 216 and the first upper limit sensor 217 may be capacitive sensors, for example.

Results of the determinations by the first lower limit sensor 216 and the first upper limit sensor 217 are output to the controller 40 described later. The controller 40 controls the operation of the foregoing upstream first pump 215 on the basis of the results of the determinations by the first lower limit sensor 216 and the first upper limit sensor 217. By doing so, the liquid level position of the ink in the first intermediary tank 213 is maintained between the lower limit position H1 and the upper limit position H2.

The downstream first ink pipe 214 is a pipe for supplying the ink from the intermediary tank 213 to the first sub-tank 71 in the printer body 10. An upstream end of the downstream first ink pipe 214 is connected to the first intermediary tank 213. A downstream end of the downstream first ink pipe 214 is connected to the first sub-tank 71.

A first three-way valve 218 and a downstream first pump 219 are interposed in a path along the downstream first ink pipe 214. The downstream first pump 219 is located downstream of the first three-way valve 218. The first three-way valve 218 allows switching in pipe connection between a normal state and a maintenance state. In the normal state, a part of the downstream first ink pipe 214 downstream of the first three-way valve 218 is connected to a part of the downstream first ink pipe 214 upstream of the first three-way valve 218. In the maintenance state, the part of the downstream first ink pipe 214 downstream of the first three-way valve 218 is connected to a maintenance pipe 32 described later. The upstream first ink pipe 212 and the downstream first ink pipe 214 may be provided with an air trap or a vacuum pump interposed at a required position.

The downstream first pump 219 is a liquid feeder that forms a downstream flow of the ink in the downstream first ink pipe 214. When the downstream first pump 219 is driven while the first three-way valve 218 is in the foregoing normal state, the ink stored in the first intermediary tank 213 is supplied to the first sub-tank 71 through the downstream first ink pipe 214. When the first three-way valve 218 is switched to the foregoing maintenance state while the downstream first pump 219 is being driven, a maintenance solution stored in a maintenance tank 85 described later is supplied to the first sub-tank 71 through the maintenance pipe 32 and the downstream first ink pipe 214. The first sub-tank 71 is provided with a level sensor not shown in the drawings. The level sensor is a sensor that determines that the liquid level of a liquid stored in the first sub-tank 71 has reduced or increased to a reference level.

Where necessary, an additional element such as a solenoid valve, a filter, or a degasifier may be provided in each of the paths along the upstream first ink pipe 212 and the downstream first ink pipe 214.

While the second ink supply mechanism 22, the third ink supply mechanism 23, and the fourth ink supply mechanism 24 are to supply inks of different colors from the first ink supply mechanism 21 and are connected to different destinations from the first ink supply mechanism 21, the configurations themselves of the second to fourth ink supply mechanisms 22 to 24 are similar to those of the first ink supply mechanism 21. More specifically, the second ink supply mechanism 22 includes a second ink tank holder 221 that supports a second ink tank 82, an upstream second ink pipe 222, a second intermediary tank 223, a downstream second ink pipe 224, an upstream second pump 225, a second lower limit sensor 226, a second upper limit sensor 227, a second three-way valve 228, and a downstream second pump 229. The third ink supply mechanism 23 includes a third ink tank holder 231 that supports a third ink tank 83, an upstream third ink pipe 232, a third intermediary tank 233, a downstream third ink pipe 234, an upstream third pump 235, a third lower limit sensor 236, a third upper limit sensor 237, a third three-way valve 238, and a downstream third pump 239. The fourth ink supply mechanism 24 includes a fourth ink tank holder 241 that supports a fourth ink tank 84, an upstream fourth ink pipe 242, a fourth intermediary tank 243, a downstream fourth ink pipe 244, an upstream fourth pump 245, a fourth lower limit sensor 246, a fourth upper limit sensor 247, a fourth three-way valve 248, and a downstream fourth pump 249. The function of each of these parts will not be described repeatedly as it is similar to the function of a corresponding part of the first ink supply mechanism 21.

<1-3. Maintenance Solution Supply Mechanism>

The maintenance solution supply mechanism 30 is a mechanism for supplying the maintenance solution to the four heads 60. In some cases, the head 60 encounters clogging of a nozzle to be caused by drying of the ink or adherence of foreign substances. The maintenance solution supply mechanism 30 supplies the maintenance solution that is a cleaning solution for cleaning the nozzle for eliminating such nozzle clogging, for example. The maintenance solution supplied from the maintenance solution supply mechanism 30 may be a preservative solution for preventing drying while the head 60 is on standby.

As shown in FIG. 2, the maintenance solution supply mechanism 30 includes a maintenance tank holder 31 and the maintenance pipe 32.

The maintenance tank holder 31 is a base for supporting the maintenance tank 85 as a source of the maintenance solution. The maintenance tank 85 is placed at the upper surface of the maintenance tank holder 31. Any shape is applicable to the maintenance tank 85. The maintenance tank 85 stores the maintenance solution therein. Initially, the maintenance solution in the maintenance tank 85 is stored to an amount set at 20 liters, for example.

The maintenance pipe 32 is a pipe for supplying the maintenance solution from the maintenance tank 85 to the foregoing first three-way valve 218, second three-way valve 228, third three-way valve 238, and the fourth three-way valve 248. As shown in FIG. 2, the maintenance pipe 32 includes a common pipe 320, a first branch pipe 321, a second branch pipe 322, a third branch pipe 323, and a fourth branch pipe 324. An upstream end of the common pipe 320 is connected to the maintenance tank 85.

The first branch pipe 321 extends from a downstream end of the common pipe 320 toward the first three-way valve 218. A downstream end of the first branch pipe 321 is connected to one port belonging to three ports of the first three-way valve 218 and not connected to the downstream first ink pipe 214. The second branch pipe 322 extends from a branch position B2 upstream of the downstream end of the common pipe 320 toward the second three-way valve 228. A downstream end of the second branch pipe 322 is connected to one port belonging to three ports of the second three-way valve 228 and not connected to the downstream second ink pipe 224.

The third branch pipe 323 extends from a branch position B3 upstream of the foregoing branch position B2 of the common pipe 320 toward the third three-way valve 238. A downstream end of the third branch pipe 323 is connected to one port belonging to three ports of the third three-way valve 238 and not connected to the downstream third ink pipe 234. The fourth branch pipe 324 extends from a branch position B4 upstream of the foregoing branch position B3 of the common pipe 320 toward the fourth three-way valve 248. A downstream end of the fourth branch pipe 324 is connected to one port belonging to three ports of the fourth three-way valve 248 and not connected to the downstream fourth ink pipe 244.

When the first three-way valve 218 is switched for connection to the maintenance pipe 32 while the downstream first pump 219 is being driven, the maintenance solution is supplied from the maintenance tank 85 to the first sub-tank 71 through the common pipe 320, the first branch pipe 321, and the downstream first ink pipe 214. When the second three-way valve 228 is switched for connection to the maintenance pipe 32 while the downstream second pump 229 is being driven, the maintenance solution is supplied from the maintenance tank 85 to the second sub-tank 72 through the common pipe 320, the second branch pipe 322, and the downstream second ink pipe 224.

When the third three-way valve 238 is switched for connection to the maintenance pipe 32 while the downstream third pump 239 is being driven, the maintenance solution is supplied from the maintenance tank 85 to the third sub-tank 73 through the common pipe 320, the third branch pipe 323, and the downstream third ink pipe 234. When the fourth three-way valve 248 is switched for connection to the maintenance pipe 32 while the downstream fourth pump 249 is being driven, the maintenance solution is supplied from the maintenance tank 85 to the fourth sub-tank 74 through the common pipe 320, the fourth branch pipe 324, and the downstream fourth ink pipe 244.

<1-4. Controller>

Figure 3:
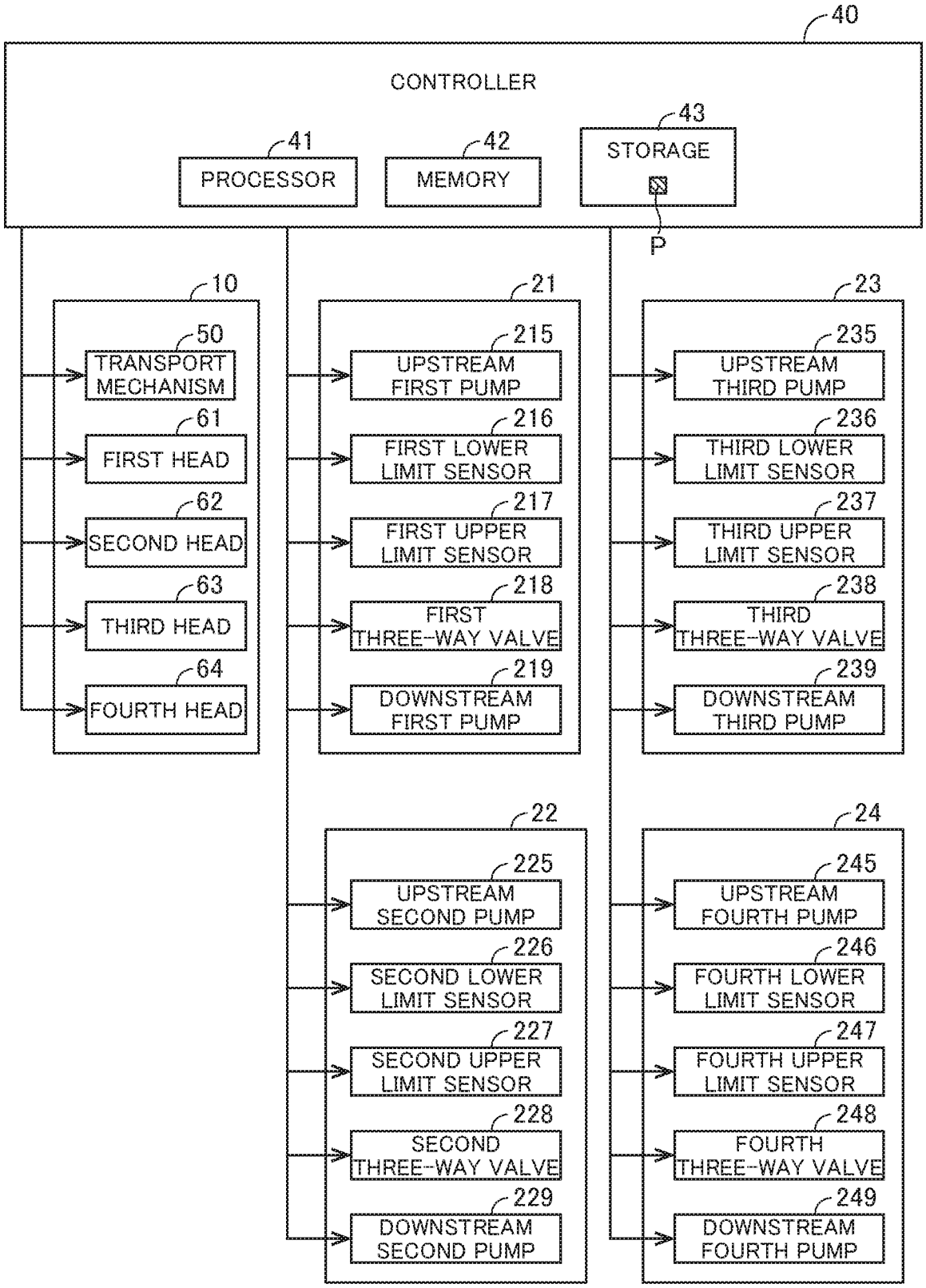
FIG. 3 shows connection between a controller and each part in the inkjet printer.

The controller 40 is means for controlling the operation of each part in the inkjet printer 1. FIG. 3 shows connection between the controller 40 and each part in the inkjet printer 1. The controller 40 of the preferred embodiment is configured using a computer. As shown in FIG. 3, the controller 40 includes a processor 41 such as a CPU, a memory 42 such as a RAM, and a storage 43 such as a hard disk drive. The storage 43 contains a computer program P for implementation of the operation of ejecting ink at the printer body 10, the operation of supplying ink from the ink supply mechanism 20, and the operation of supplying the maintenance solution from the maintenance solution supply mechanism 30.

As shown in FIG. 3, the controller 40 is electrically connected to each of the foregoing transport mechanism 50, first head 61, second head 62, third head 63, fourth head 64, upstream first pump 215, first lower limit sensor 216, first upper limit sensor 217, first three-way valve 218, downstream first pump 219, upstream second pump 225, second lower limit sensor 226, second upper limit sensor 227, second three-way valve 228, downstream second pump 229, upstream third pump 235, third lower limit sensor 236, third upper limit sensor 237, third three-way valve 238, downstream third pump 239, upstream fourth pump 245, fourth lower limit sensor 246, fourth upper limit sensor 247, fourth three-way valve 248, and downstream fourth pump 249.

The controller 40 reads the computer program P from the storage 43 temporarily onto the memory 42 and the processor 41 performs arithmetic processing on the basis of the read computer program P, thereby controlling the operation of each of the foregoing parts. This makes progress of the operations including ejection of ink at the printer body 10, supply of ink from the ink supply mechanism 20, and supply of the maintenance solution from the maintenance solution supply mechanism 30.

<2. Operation of Supplying Maintenance Solution>

Figure 4:
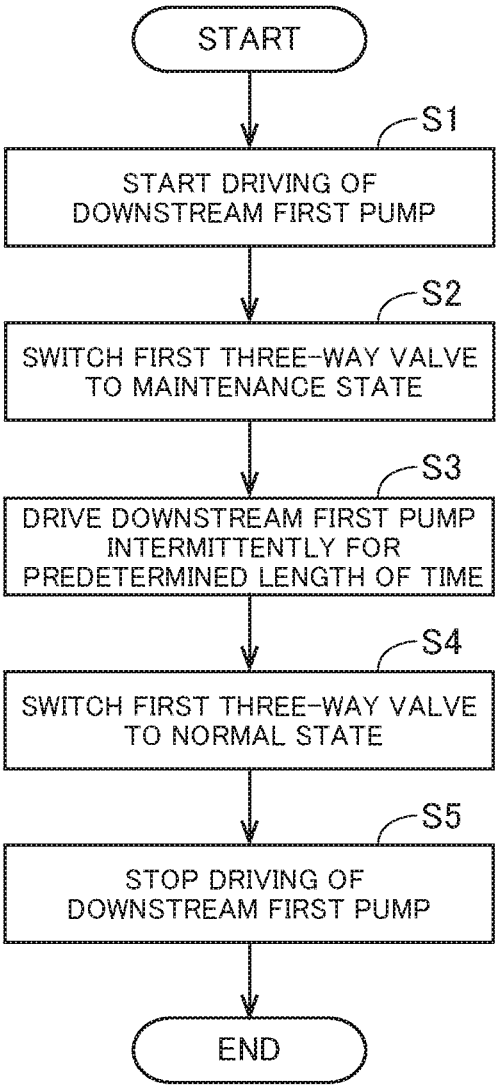
FIG. 4 is a flowchart showing a procedure of supplying a maintenance solution to a first head.

The following describes maintenance process of supplying the maintenance solution to the head 60 in the foregoing inkjet printer 1. In the following description, a procedure taken for supplying the maintenance solution to the first head 61 will be described as an example by following the flowchart in FIG. 4.

First, while the first three-way valve 218 is in the state of forming connection to the first intermediary tank 213 (normal state), the controller 40 starts driving of the downstream first pump 219 (step S1). In this state, the color K ink is supplied from the first intermediary tank 213 to the first sub-tank 71 through the downstream first ink pipe 214.

While the downstream first pump 219 is kept driven, the controller 40 thereafter switches the first three-way valve 218 from the foregoing normal state to the state of forming connection to the maintenance tank 85 (maintenance state) (step S2). By doing so, the maintenance solution is supplied from the maintenance tank 85 to the first sub-tank 71 through the common pipe 320, the first branch pipe 321, and the downstream first ink pipe 214.

Next, the controller 40 drives the downstream first pump 219 on the basis of a signal from the level sensor (not shown in the drawings) provided at the first sub-tank 71. More specifically, if the level sensor determines that a liquid level in the first sub-tank 71 has reduced to the reference level, the controller 40 drives the downstream first pump 219 until the liquid level recovers to the reference level. In response to this, the downstream first pump 219 supplies the maintenance solution to the first sub-tank 71. When the liquid level has recovered to the reference level, driving of the downstream first pump 219 is stopped. In this way, the controller 40 drives the downstream first pump 219 intermittently (step S3). In parallel with the intermittent driving of the downstream first pump 219, a cap mechanism not shown in the drawings sucks a nozzle surface of the first head 61. By doing so, the maintenance solution in the first head 61 is pushed out toward the cap mechanism. Such intermittent driving of the downstream first pump 219 continues for a predetermined length of time to replace the ink in the first sub-tank 71 and the first head 61 by the maintenance solution. In this way, each nozzle of the first head 61 is treated by means of cleaning, for example.

After passage of the predetermined length of time, the controller 40 switches the first three-way valve 218 from the foregoing maintenance state to the normal state while keeping the downstream first pump 219 driven (step S4). After the first three-way valve 218 is switched to the normal state, the controller 40 stops driving of the downstream first pump 219 (step S5). By doing so, supply of the maintenance solution from the maintenance solution supply mechanism 30 is stopped.

The maintenance solution may be supplied to the second head 62 by operating the second three-way valve 228 and the downstream second pump 229 by following a procedure similar to the foregoing procedure. The maintenance solution may be supplied to the third head 63 by operating the third three-way valve 238 and the downstream third pump 239 by following a procedure similar to the foregoing procedure. The maintenance solution may be supplied to the fourth head 64 by operating the fourth three-way valve 248 and the downstream fourth pump 249 by following a procedure similar to the foregoing procedure.

Supplies of the maintenance solution to the first to fourth heads 61 to 64 may proceed individually or simultaneously.

As described above, the inkjet printer 1 achieves supply of the maintenance solution instead of ink to each of the four heads 61 to 64 by means of switching of the three-way valve. The maintenance solution is supplied to each of the heads 61 to 64 from the common maintenance tank 85. Specifically, while the inkjet printer 1 includes the four ink supply mechanisms 20, it includes one maintenance solution supply mechanism 30. This makes it possible to suppress size increase of the inkjet printer 1, compared to a case where the maintenance solution supply mechanism 30 is provided individually for each head 60.

In the inkjet printer 1, the maintenance pipe 32 is connected to the ink pipes 214, 224, 234, and 244 at positions downstream of the intermediary tanks 213, 223, 233, and 243 respectively of the ink supply mechanisms 20. This eliminates the need of replacement of the interiors of the intermediary tanks 213, 223, 233, and 243 by the maintenance solution during supply of the maintenance solution. This allows reduction in the consumptions of the inks and the maintenance solution.

In particularly, the maintenance pipe 32 of the preferred embodiment includes the common pipe 320, and the four branch pipes 321, 322, 323, and 324 extending from the common pipe 320 toward the three-way valves 218, 228, 238, and 248 respectively of the ink supply mechanisms 20. Thus, even if the ink of a small amount flows backward from any of the three-way valves 218, 228, 238, and 248 into a corresponding one of the branch pipes 321, 322, 323, and 324, this ink is unlikely to reach the common pipe 320. This makes it possible to reduce the occurrence of mixture of ink colors through the common pipe 320.

To reduce the probability of reach of the inks from the three-way valves 218, 228, 238, and 248 to the common pipe 320 through the branch pipes 321, 322, 323, and 324 respectively, each of the branch pipes 321, 322, 323, and 324 preferably has a certain length. More specifically, each of the branch pipes 321, 322, 323, and 324 preferably has a length of 30 mm or more. More preferably, each of the branch pipes 321, 322, 323, and 324 has a length of 50 mm or more. Meanwhile, if each of the branch pipes 321, 322, 323, and 324 is too long, a resistance is increased in a flow path along each of the branch pipes 321, 322, 323, and 324, Thus, the length of each of the branch pipes 321, 322, 323, and 324 is preferably set so as not to exceed 100 mm, for example.

In the preferred embodiment, for switching of the three-way valves 218, 228, 238, and 248 from the normal state to the maintenance state such as that in step S2 described above, this switching is made while corresponding ones of the pumps 219, 229, 239, and 249 are being driven. The pumps 219, 229, 239, and 249 are kept driven until the three-way valves 218, 228, 238, and 248 are switched again to the normal state like in steps S3 to S5. By doing so, downstream suction force is applied at the time of switching of the three-way valves 218, 228, 238, and 248 to reduce the occurrences of backflows of the inks themselves into the branch pipes 321, 322, 323, and 324. This makes it possible to reduce the occurrence of mixture of ink colors through the maintenance pipe 32 to a greater extent.

In the preferred embodiment, the fourth three-way valve 248 corresponding to the color Y is connected to the most upstream position of the maintenance pipe 32. The third three-way valve 238 corresponding to the color M is connected to the position of the maintenance pipe 32 downstream of the fourth three-way valve 248. The second three-way valve 228 corresponding to the color C is connected to the position of the maintenance pipe 32 downstream of the third three-way valve 238. Further, the first three-way valve 218 corresponding to the color K ink is connected to the position of the maintenance pipe 32 downstream of the second three-way valve 228.

The color K ink becomes easily noticeable when mixed with ink of a different color so exerts large influence on a printing result. The foregoing connection of the first three-way valve 218 corresponding to the color K to the most downstream position of the maintenance pipe 32 particularly functions to prevent mixture of the color K ink with different ink through the maintenance pipe 32. Colors are ranked as follows in terms of the magnitude of influence caused by mixture with ink of a different color: color K >color C >color M >color Y. In consideration of this, in the preferred embodiment, the three-way valves 218, 228, 238, and 248 for the corresponding colors are connected to the maintenance pipe 32 in the foregoing order. This makes it possible to reduce the occurrence of mixture of ink colors. Further, even on the occurrence of mixture of ink colors, this still makes it possible to reduce influence on a printing result.

The foregoing order in which the three-way valves 218, 228, 238, and 248 for the corresponding colors are connected to the maintenance pipe 32 is not always required to match the order in which the heads 60 are aligned at the printer body 10.

<3. Modifications>

While the one preferred embodiment of the present invention has been described above, the present invention is not limited to the foregoing preferred embodiment.

Figure 5:
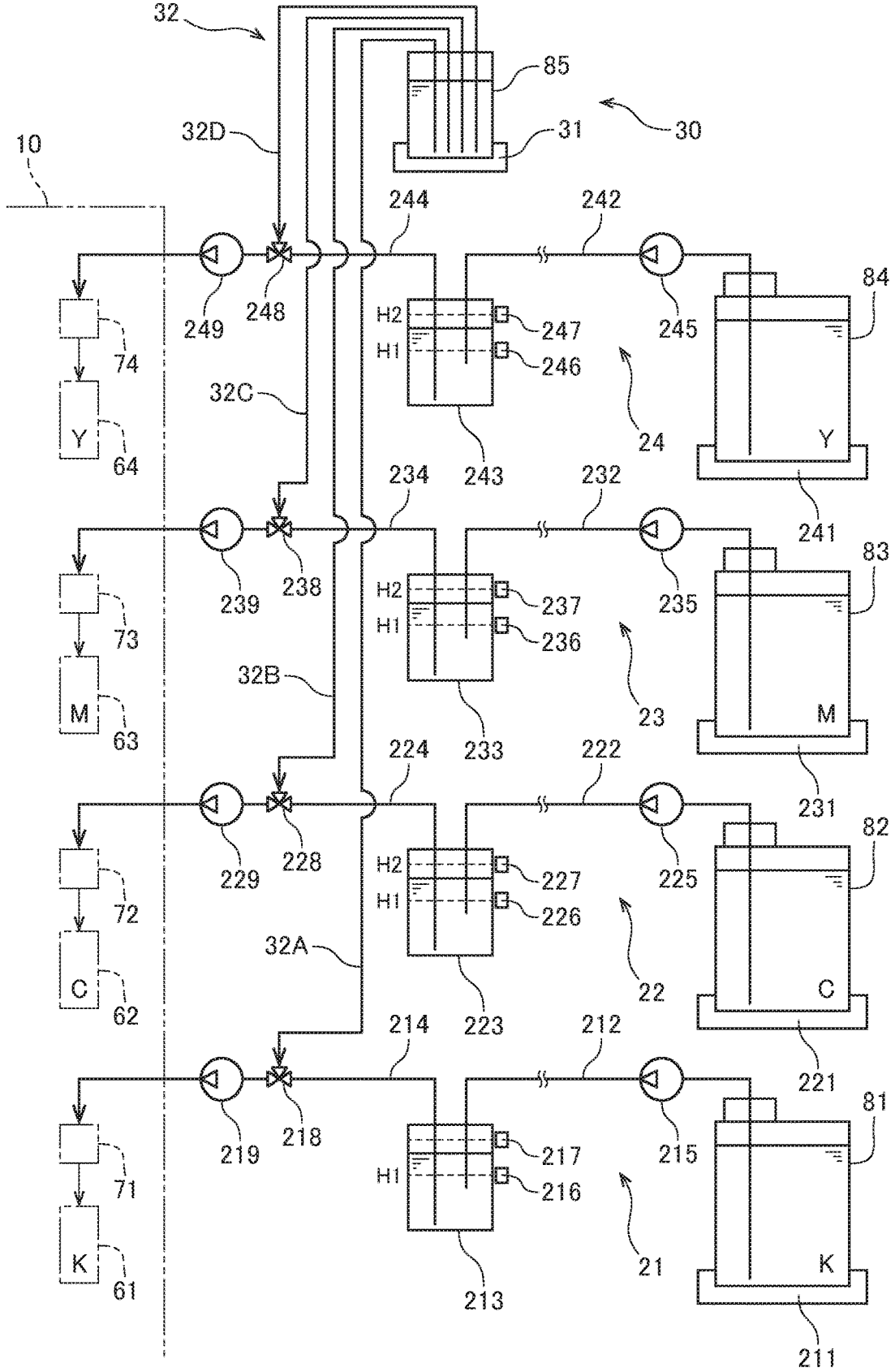
FIG. 5 shows the configuration of a maintenance solution supply mechanism according to a modification.

FIG. 5 shows the configuration of a maintenance solution supply mechanism 30 according to a modification. In the illustration of FIG. 5, the maintenance pipe 32 includes a first maintenance pipe 32A, a second maintenance pipe 32B, a third maintenance pipe 32C, and a fourth maintenance pipe 32D. The first maintenance pipe 32A is one pipe connecting the maintenance tank 85 and the first three-way valve 218. The second maintenance pipe 32B is one pipe connecting the maintenance tank 85 and the second three-way valve 228. The third maintenance pipe 32C is one pipe connecting the maintenance tank 85 and the third three-way valve 238. The fourth maintenance pipe 32D is one pipe connecting the maintenance tank 85 and the fourth three-way valve 248.

As described above, in the illustration of FIG. 5, the four maintenance pipes 32 are arranged in parallel between the maintenance tank 85 and the three-way valves 218, 228, 238, and 248. Specifically, the maintenance pipe 32 in FIG. 5 does not include a common pipe itself. This further reduces the risk of mixture of ink colors through the maintenance pipe 32.

In the foregoing preferred embodiment, the color K ink, the color C ink, the color M ink, and the color Y ink are called the "first ink," the "second ink," the "third ink," and the "fourth ink" respectively. However, the "first ink" of the present invention may be ink of a color other than the color K. Further, the "second ink" of the present invention may be ink of a color other than the color C.

In the foregoing preferred embodiment, the four heads 60 are provided in the printer body 10. Meanwhile, the number of the heads 60 in the printer body 10 may be one, two or three, or five or more. For example, a head for ejection of ink of a spot color may be provided in addition to heads corresponding to the colors K, C, M, and Y. The ink supply mechanism 20 may be provided for each of ink colors to be used.

The ink used in the present invention may either be water-based ink or oil-based ink. The ink used in the present invention may be ink to be dried by evaporation of a solvent, or may be photo-curing ink to be cured by irradiation with light such as ultraviolet light.

The foregoing inkjet printer 1 is to print an image on the printing paper 9 as a printing medium. However, the inkjet printer of the present invention may be configured to print an image on a sheet-like printing medium other than general paper (for example, a resin film, metal foil, or glass).

The components described in the foregoing preferred embodiment and in the modifications may be combined together, as appropriate, without inconsistencies.

While the invention has been shown and described in detail, the foregoing description is in all aspects illustrative and not restrictive. It is therefore understood that numerous modifications and variations can be devised without departing from the scope of the invention.

What is claimed is:

1. An inkjet printer comprising:

a first head that ejects first ink toward a printing medium;

a second head that ejects second ink of a different color from said first ink toward said printing medium;

a first ink supply mechanism that supplies said first ink to said first head;

a second ink supply mechanism that supplies said second ink to said second head; and a maintenance solution supply mechanism that supplies a maintenance solution to said first head and said second head, wherein said first ink supply mechanism includes:

a first ink pipe through which said first ink is supplied from a first tank to said first head; and a first three-way valve provided on a path along said first ink pipe, wherein said second ink supply mechanism includes:

a second ink pipe through which said second ink is supplied from a second tank to said second head; and a second three-way valve provided on a path along said second ink pipe, wherein said maintenance solution supply mechanism includes a maintenance pipe through which said maintenance solution is supplied from a maintenance tank storing said maintenance solution to said first three-way valve and said second three-way valve, wherein said first ink supply mechanism further includes a first pump located downstream of said first three-way valve on the path along said first ink pipe, and wherein said second ink supply mechanism further includes a second pump located downstream of said second three-way valve on the path along said second ink pipe.

2. The inkjet printer according to claim 1, wherein said maintenance pipe includes:

a common pipe extending from said maintenance tank;

a first branch pipe connecting said common pipe and said first three-way valve; and a second branch pipe connecting said common pipe and said second three-way valve.

3. The inkjet printer according to claim 2, wherein each of said first branch pipe and said second branch pipe has a length of 30 mm or more.

4. The inkjet printer according to claim 1, further comprising a controller, wherein said controller controls said first three-way valve, said second three-way valve, said first pump, and said second pump in such a manner that, for switching of said first three-way valve from a normal state of forming connection to said first tank to a maintenance state of forming connection to said maintenance tank, said controller makes said switching while said first pump is being driven and continues driving of said first pump until said first three-way valve is switched again to said normal state, and for switching of said second three-way valve from a normal state of forming connection to said second tank to a maintenance state of forming connection to said maintenance tank, said controller makes said switching while said second pump is being driven and continues driving of said second pump until said second three-way valve is switched again to said normal state.

5. The inkjet printer according to claim 1, wherein said first ink is black ink, said second ink is ink of a color other than black, and said first three-way valve is connected to a position of said maintenance pipe downstream of said second three-way valve.

6. The inkjet printer according to claim 1, wherein each of said first tank and said second tank is an intermediary tank that temporarily stores ink supplied from a source of the ink.

7. The inkjet printer according to claim 1, wherein said maintenance solution is a cleaning solution used for cleaning said first head and said second head.

8. A maintenance method employed in an inkjet printer that supplies first ink from a first tank to a first head through a first ink pipe and supplies second ink of a different color from said first ink from a second tank to a second head through a second ink pipe, the method being for maintaining said first head and second head and comprising the steps of:

a) supplying a maintenance solution from a maintenance tank to said first head by switching a first three-way valve provided in said first ink pipe; and b) supplying said maintenance solution from said maintenance tank to said second head by switching a second three-way valve provided in said second ink pipe, wherein in said step a), a first pump located downstream of said first three-way valve on a path along said first ink pipe is driven, wherein in said step b), a second pump located downstream of said second three-way valve on a path along said second ink pipe is driven.

9. The maintenance method according to claim 8, wherein in said step a), while the first pump located downstream of said first three-way valve on the path along said first ink pipe is being driven, said first three-way valve is switched from a normal state of forming connection to said first tank to a maintenance state of forming connection to said maintenance tank, and driving of said first pump is continued until said first three-way valve is switched again to said normal state, and in said step b), while the second pump located downstream of said second three-way valve on the path along said second ink pipe is being driven, said second three-way valve is switched from a normal state of forming connection to said second tank to a maintenance state of forming connection to said maintenance tank, and driving of said second pump is continued until said second three-way valve is switched again to said normal state.

* * * * *